United States Patent [19]

Endo et al.

[11] Patent Number: 4,902,244

[45] Date of Patent: Feb. 20, 1990

[54] CONNECTOR

[75] Inventors: Takayoshi Endo; Shigemitsu Inaba; Shigemi Hashizawa, all of Shizuoka, Japan

[73] Assignee: Yazaki Corporation, Japan

[21] Appl. No.: 354,360

[22] Filed: May 19, 1989

[30] Foreign Application Priority Data

May 20, 1988 [JP] Japan ..... 63-123573

[51] Int. Cl.[4] ..... H01R 3/00

[52] U.S. Cl. ..... 439/489; 235/464; 235/494

[58] Field of Search ..... 439/488, 489, 352; 235/462, 464, 494, 375; 206/328; 220/342; 361/395, 399, 393; 340/653

[56] References Cited

U.S. PATENT DOCUMENTS 4,454,413 6/1984 Morton, Jr. ..... 235/494
4,507,697 3/1985 Ozil et al. ..... 439/489 X
4,636,634 1/1987 Harper et al. ..... 235/462 X
4,784,614 11/1988 Sadigh-Behzadi ..... 439/488
4,820,193 4/1989 Noorily ..... 439/488

FOREIGN PATENT DOCUMENTS 53-95187 8/1978 Japan .
2042285 9/1980 United Kingdom ..... 439/488

*Primary Examiner*—William Briggs
*Attorney, Agent, or Firm*—Wigman & Cohen

[57] ABSTRACT

A connector comprising a male and female housing, in which one wall of the female housing is provided with an arrangement of slits having specific widths and spacings which, in combination with a layer of black paint provided on the side wall of the male housing that faces to slits, define a bar code. By having this feature, the fitting state of the male and female housings can be determined and the connector can be identified by type with the use of a bar code reader.

10 Claims, 4 Drawing Sheets

OUTPUT WAVEFORM

CONNECTOR

BACKGROUND OF THE INVENTION

1. Field of the Invention

The present invention relates to a connector, and more particularly to a connector having male and female housings in which a simple detection means is provided to be read by an optical scanner for confirming a proper fitting of the two housings and for identifying the connector by type.

2. Description of the Prior Art

In the field of prior art connectors, a connector having a fitting state confirmation means that makes use of an optical scanner has been disclosed in Japanese Laid Open Utility Model Publication No. 53-95187. As described therein, the connector comprises a male housing provided with a reflection plate for reflecting light from a light-emitting element to a light-detection device, and a female housing provided with first and second optical passageways to allow light from the light-emitting element to reach the reflection plate and to allow the reflected light from the reflection plate to reach the light-detection device, respectively, when the two housings are properly fitted to each other. In this construction, since the first and second passageways are inclined with respect to each other, only when a proper fitting state of the two housings has been achieved will the light reflected from the reflection plate be able to reach the light-detection device. Thus, the light-emitting element and the light-detection device can be utilized to confirm a proper fitting of the two housings.

Unfortunately, even though the fitting confirmation means mentioned above is effective in confirming a proper fitting of the two housings, it necessitates making a complicated structure for the connector. This in turn increases the complexity of the manufacturing process, thus leading to higher manufactoring costs.

Furthermore, the overall process of confirming a proper fitting state is very troublesome because the light-emitting element and the light-detection device must be precisely aligned with the first and second passageways, respectively.

SUMMARY OF THE INVENTION

In view of the disadvantages of the prior art connectors, it is an object of the present invention to provide a connector comprising male and female housings with a simple detection means for confirming a proper fitting of the male and female housings.

It is another object of the present invention to provide a connector with a fitting detection means that also allows the connector to be identified by type.

It is still another object of the present invention to provided a connector having a fitting detection means that can easily be read by a bar code reader.

It is yet another object of the present invention to provide a connector having a fitting detection means which is easy to manufacture at a relatively low cost.

To achieve the above objectives, the connector comprises male and female housings which are provided with a fitting detection means that forms a bar code when the male and female housings are properly fitted to each other. This is accomplished by forming slits of predetermined widths and spacings in a side wall of the female housing and by providing a non-reflective black layer of material on a side wall of the male housing that faces the slits of the female housing when the two housings are fitted together. Alternatively, use can be made of both reflective and non-reflective layers in combination with the slits to define the bar code.

The foregoing, and other objects, features, and advantages of the present invention will become more apparent from the detailed description of the preferred embodiments taken in conjunction with the accompanying drawings.

DETAILED DESCRIPTION OF THE PREFERRED EMBODIMENT

With reference to FIGS. 1–6, a connector according to a first embodiment of the present invention will be described.

Figure 1:
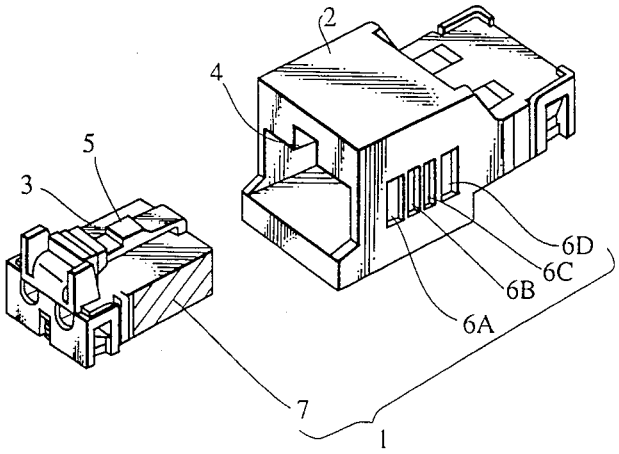
FIGS. 1, 3 and 5 are perspective views showing various fitting stages of a connector according to a first embodiment of the present invention.

As shown in FIG. 1, a connector 1 comprises a female housing 2 and a male housing 3 fittable to the female housing 2. Inside the opening of the female housing 2 on an upper surface thereof is formed a locking groove 4, and provided on a top surface of the male housing 2 is a locking protrusion 5 which passes into the locking groove 4 and locks therewith when the male housing 3 has been fitted to the female housing 2.

Further, in one side wall of the female housing 2 there is formed a plurality of slits 6A–6D having specific widths and spacings, and provided on a side wall of the male housing 3 is a layer of non-reflective black material 7, such as black paint or the like. It is then this combination of the slits 6A–6D and the layer of black paint 7 that constitute a bar code means that allows the fitting state of the housings 2 and 3 to be determined and which allows the connector 1 to be identified by type.

Now, to better understand the function of the black paint 7 and the slits 6A–6D, FIG. 1 will be used further in conjunction with FIGS. 2–5 to illustrate an example of how the confirmation and identifications means work when the connector 1 is being used.

First, with reference again to FIG. 1, the state of the connector 1 is shown just prior to the insertion of the male housing 3 into the female housing 2. In this state the slits 6A–6D simply act as little windows into the hollow region of the female housing 2.

Figure 2:
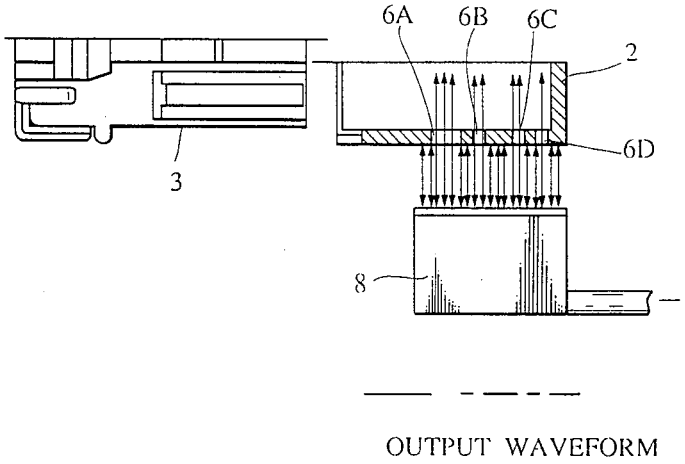
FIGS. 2, 4 and 6 are partial cross-sectional views of a connector according to the first embodiment showing the resulting output signals obtained for the fitting stages shown in FIGS. 1, 3 and 5, respectively.

At this point, if a bar code reader 8 or the like is made to scan over the slits 6A–6D as shown in FIG. 2, it will pick up an image and convert it into an eletrical signal. Then, after the electrical signal has been sent to an arithmetic processor (not shown) and compared with prestored signals used indicate a proper fitting state, it will be determined that the signal is incomplete, thereby directly indicating that the fitting state of the two housings is either incomplete or improper.

Figure 3:
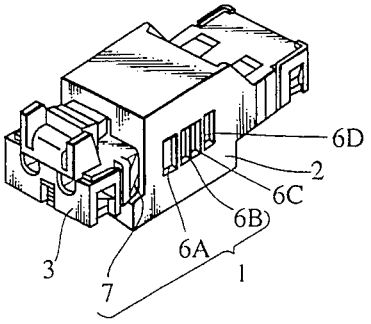
Figure 4:
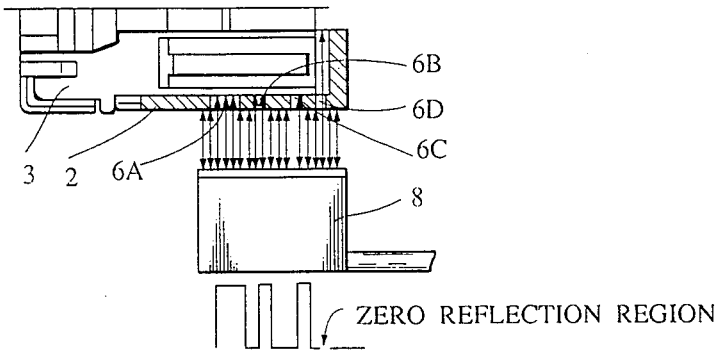

Next, as shown in FIGS. 3 and 4, the connector 1 is in a state in which the male housing 3 has been inserted into the female housing 2 far enough that slits 6A–6C are blocked on the inside of the female housing 2 by the black layer 7 of the male housing 3. In this state, slit 6D is the only slit that is not blocked off. Therefore, when the bar code reader 8 is passed over the slits 6A–6D, a more complete signal than that of FIG. 2 is obtained, but this signal is still lacking the image data from slit 6D. Consequently, the signal is still judged to be incomplete, from which it follows that the two housings 2 and 3 are still not fitted properly to each other.

Figure 5:
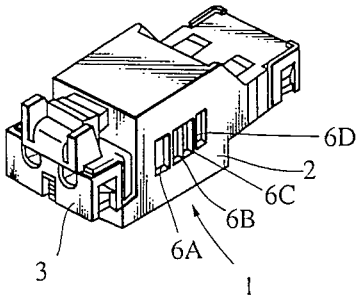
Figure 6:
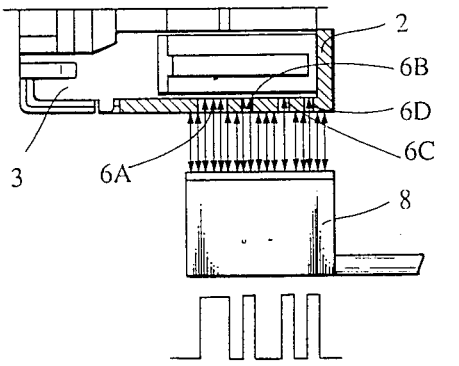

Finally, shown in FIG. 5 is the state in which the male housing 3 has been inserted all the way into the female housing 2. As soon as this state has been reached, all the slits 6A–6D will be blocked off by the black paint 7 to form a bar code image that will register as a complete bar code signal when scanned by the bar code reader 8, as shown in FIG. 6. Thus, the fitting state of the male and female housings 3,2 will be judged to be complete.

With respect to the above example, it is to be noted that the bar code can also be used to identify the type of connector being tested for a proper fitting state. This is carried out simply by using any conventional bar code reading system in which bar codes are preselected and stored to later identify specific items. Thus, once the bar code has been judged by an arithmetic processor or the like to be a complete code, a proper fitting state of the two housings 2 and 3 will be confirmed, as well as allowing the connector 1 to be identified by type.

Figure 7:
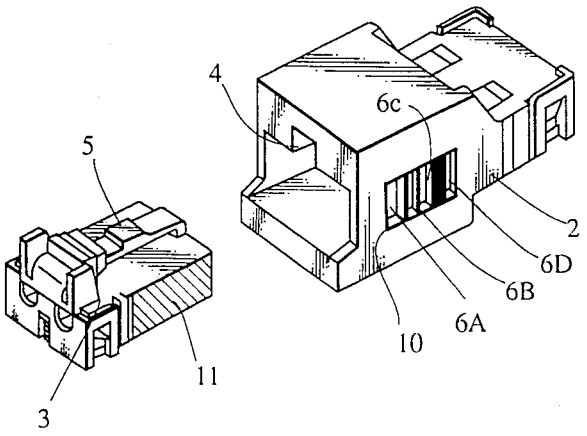
FIG. 7 is perspective view of a connector according to a second embodiment of the present invention.

With reference now to FIG. 7, there is shown a second embodiment of a connector according to the present invention. As the second embodiment is similar to the first embodiment, the second embodiment will be described primarily in terms of differences with respect to the first embodiment. Namely, in the second embodiment the female housing 2 is provided with a layer of black paint 10 formed around the slits 6A–6D in the form of a rectangle, with the black paint layer 7 of the male housing 3 being replaced by a layer of reflective material, such as silver paint or the like. The effect of these minor changes from the first embodiment serves to reverse the bar code pattern read by the bar code reader. However, this reversed code is used in exactly the same way the code was used in the first embodiment.

Figure 8:
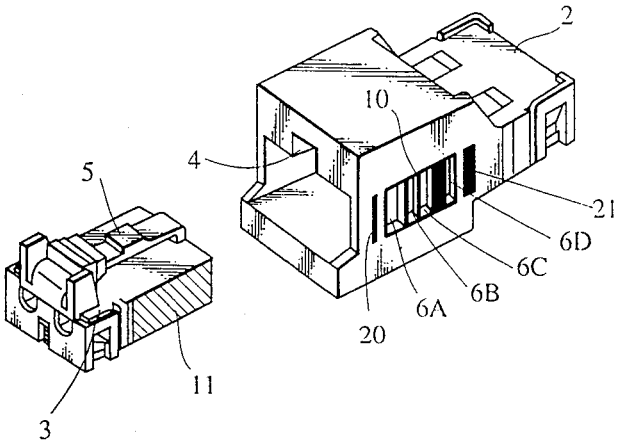
FIG. 8 is perspective view of a connector according to a third embodiment of the present invention.

In FIG. 8 there is shown a third embodiment of a connector according to the present invention. Here the only difference from the second embodiment is that the female housing 2 of the third embodiment is additionally provided with a detection start code 20 and a detection stop code 21 before and after the black layer of paint 10, respectively.

From the descriptions of the preferred embodiments above, it is quite clear that the present invention provides a connector that allows the engagement of the male and female housings to be tested for a proper fitting state. In addition, the confirmation automatically allows the connector to be identified by type. Moreover, by using a bar code for these purposes, these confirmation and identification processes can be carried out simultaneously in a very convenient and easy manner when the connector is either stationary or in motion.

Furthermore, when the connector according to the present invention is used for an assembly process involving an assembly line, it is possible for the connector to be scanned manually or automatically. In either case the operator or inspector could be informed of an improper fitting by providing an alarm buzzer or the like, or even a a shut-down mechanism in the case of automatic scanning, which would be activated by the arithmetic processor upon the detection of an improper signal.

Finally, it is to be understood that even though the present invention has been described in its preferred embodiments, many modifications and improvements may be made without departing from the scope of the invention as defined by the appended claims.

What is claimed is:

1. A connector, comprising:

a female housing having a side wall, a hollow chamber and an entrance opening to the hollow chamber;

a male housing having an insertion section which is slidably inserted through the entrance opening of the female housing into the hollow chamber thereof when the male and female housings are to be fitted to each other; and means for detecting a fitting state of the male and female housings, the fitting state detecting means comprising a bar code means arranged on the housings so as to be readable by a bar code reader.

2. The connector of claim 1, wherein the bar code means comprises a plurality of slits formed in the side wall of the female housing, the slits optically communicating with the hollow chamber, and a layer of non-reflective black material provided on a portion of the insertion section of the male housing that faces all the slits when the male and female housings are fitted together.

3. The connector of claim 2, wherein the slits are provided with predetermined widths and spacings so as to constitute a bar code in combination with the layer of the male housing.

4. The connector of claim 3, wherein the bar code is predefined to enable the connector to be identified by a bar code reader.

5. The connector of claim 2, wherein the non-reflective black material comprises black paint.

6. The connector of claim 1, wherein the bar code means comprises a plurality of slits formed on the side wall of the female housing, the slits optically communicating with the hollow chamber, a layer of non-reflective black material provided on a part of the side wall of the female housing so as to surround the slits, and a layer of reflective material provided on a portion of the insertion section of the male housing that faces all the slits when the male and female housings are fitted together.

7. The connector of claim 6, wherein the slits are provided with predetermined widths and spacings so as to constitute a bar code in combination with the layer of the male housing.

8. The connector of claim 6, wherein the bar code is predefined to enable the connector to be identified by a bar code reader.

9. The connector of claim 7, wherein the non-reflective black material comprises black paint, and the reflective material comprises silver paint.

10. The connector of claim 6, further comprising a start position detection code and a stop position detection code located on both sides of the bar code.

* * * * *